US006398702B1

(12) United States Patent
Schlafer et al.

(10) Patent No.: US 6,398,702 B1
(45) **Date of Patent: *Jun. 4, 2002**

(54) ROLL HAVING ZIRCONIA COATING

(75) Inventors: Michelle L. Schlafer, Fairport; Ann M. Kazakos, Webster; Joy L. Longhenry, Webster; Tim R. Jaskowiak, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/503,936

(22) Filed: Feb. 14, 2000

(51) Int. Cl.[7] ..... B25F 5/02

(52) U.S. Cl. ..... 492/58; 492/53; 29/895.32

(58) Field of Search ..... 492/58, 53, 49, 492/18, 28; 29/895, 895.32; 399/286; 428/632, 469

(56) References Cited

U.S. PATENT DOCUMENTS

| | | | | |
|---|---|---|---|---|
| 4,716,134 | A | 12/1987 | Yamaguchi et al. | |
| 4,822,689 | A | 4/1989 | Fukubayashi et al. | |
| 4,830,996 | A | 5/1989 | Hirai et al. | |
| 4,893,151 | A | 1/1990 | Yamazaki et al. | |
| 4,897,374 | A | 1/1990 | Matsumoto et al. | |
| 5,073,415 | A | * 12/1991 | Taylor et al. | 427/433 |
| 5,219,809 | A | 6/1993 | Kato et al. | |
| 5,245,392 | A | 9/1993 | Behe et al. | |
| 5,253,016 | A | 10/1993 | Behe et al. | |
| 5,300,339 | A | 4/1994 | Hays et al. | |
| 5,322,970 | A | 6/1994 | Behe et al. | |
| 5,338,893 | A | 8/1994 | Edmunds et al. | |
| 5,358,913 | A | * 10/1994 | Chatterjee et al. | 428/34.6 |
| 5,384,627 | A | 1/1995 | Behe et al. | |
| 5,466,208 | A | * 11/1995 | Jackson et al. | 492/53 |
| 5,473,418 | A | 12/1995 | Kazakos et al. | |
| 5,563,690 | A | 10/1996 | Hasegawa et al. | |
| 5,600,414 | A | * 2/1997 | Hyllberg | 492/53 |
| 5,667,641 | A | * 9/1997 | Poirier et al. | 492/53 |
| RE35,698 | E | 12/1997 | Behe et al. | |
| 5,701,572 | A | * 12/1997 | Behe et al. | 399/354 |
| 5,707,326 | A | * 1/1998 | Hyllberg | 492/53 |
| 5,761,598 | A | 6/1998 | Kazakos et al. | |
| 5,805,968 | A | 9/1998 | Chatterjee et al. | |
| 5,861,692 | A | * 1/1999 | Furlani et al. | 492/53 |
| 5,941,170 | A | * 8/1999 | Davis et al. | 492/53 |
| 6,174,089 | B1 | * 1/2001 | Kitamura et al. | 384/492 |
| 6,327,452 | B1 | * 12/2001 | Jaskowiak et al. | 492/28 |

FOREIGN PATENT DOCUMENTS

| | | | | |
|---|---|---|---|---|
| EP | 0 701 177 | A1 | 3/1996 | |
| EP | 1126329 | A1 * | 8/2001 | |
| JP | 54148166 | A * | 11/1979 | |
| JP | 405271897 | A * | 10/1993 | 427/453 |
| JP | 07133126 | A * | 5/1995 | |
| JP | 07268594 | A * | 10/1995 | |

* cited by examiner

*Primary Examiner*—S. Thomas Hughes
*Assistant Examiner*—Marc Jimenez
(74) *Attorney, Agent, or Firm*—Oliff & Berridge, PLC

(57) ABSTRACT

Rolls include a core and a stabilized zirconia-containing outer coating on the core. The outer coating can also include titania. The outer coatings have smooth finishes and controlled electrical properties. The outer coatings of the rolls can be finished to a highly smooth finish in reduced cycle times. The rolls can be used in electrostatographic imaging apparatus as charge donor rolls.

28 Claims, 3 Drawing Sheets

ROLL HAVING ZIRCONIA COATING

BACKGROUND OF THE INVENTION

1. Field of Invention

This invention relates to electrostatographic imaging devices.

2. Description of Related Art

Electrostatic reproduction involves uniformly charging a photoconductive member, or photoreceptor, and imagewise discharging it, or imagewise exposing it, based on light reflected from an original image being reproduced. The result is an electrostatically-formed latent image on the photoconductive member. The latent image is developed by bringing a charged developer material into contact with the photoconductive member.

Two-component and single-component developer materials are known. Two-component developer materials comprise magnetic carrier particles and charged toner particles that adhere triboelectrically to the carrier particles and are intended to adhere the photoconductive member.

A single-component developer material typically consists of only toner particles. The toner particles typically have an electrostatic charge to adhere to the photoconductive member, and magnetic properties to magnetically convey the toner particles from the sump to the magnetic roll. The toner particles adhere directly to the donor roll by electrostatic charges. The toner particles are attracted to the donor roll from a magnet or developer roll. From the donor roll, the toner is transferred to the photoconductive member in the development zone.

For both types of developer material, the charged toner particles are brought into contact with the latent image to form a toner image on the photoconductive member. The toner image is transferred to a receiver sheet, which passes through a fuser device where the toner particles are heated and permanently fused to the sheet, forming a hard copy of the original image.

A development device is used to bring the charged toner particles into contact with the latent image formed on the photoreceptor, so that the toner particles adhere electrostatically to the charged areas on the latent image. The development device typically includes a chamber in which the developer material is mixed and charged.

One type of two-component development method and apparatus is known as "scavengeless development." In scavengeless development systems, toner is detached from the donor roll by applying an alternating current (AC) electric field to electrodes disposed between the donor roll and the photoconductive member. There is no physical contact between the development apparatus and the photoconductive member. Scavengeless development is useful in apparatus in which different types of toner are supplied to the same photoconductive member. "Hybrid" scavengeless development apparatus typically include a mixing chamber that holds a two-component developer material, a developer material developer or magnetic roll, a donor roll, a development zone, and an electrode structure at the development zone between the donor roll and the photoconductive member. The donor roll receives charged toner particles from the developer roll and transports the particles to the development zone. An AC voltage is applied to the electrodes to form a toner cloud in the development zone. Electrostatic fields generated by an adjacent latent image on the photoconductive member surface attract charged toner particles from the toner cloud to develop the latent image on the photoconductive member.

Another variation on scavengeless development uses single-component developer material development systems. As in two-component developer material development systems, the donor roll and electrodes also create a toner cloud.

SUMMARY OF THE INVENTION

In both one-component and two-component developer scavengeless development systems, the electrical, chemical and physical characteristics of the donor roll affect the ability of the development apparatus to effectively transport toner particles into the development zone and to achieve high-quality image development. The donor roll should have characteristics that enable charged toner particles to effectively and controllably adhere electrostatically to the donor roll's outer surface. In addition, the donor roll should have the desired electrical properties for donating toner particles to the photoconductive member. It is desirable that the electrical properties of the donor roll be uniform and also be tunable.

It is also desirable that the outer surface of the donor roll have a smooth finish or low roughness.

It is also desirable that the outer surface of the donor roll have good machining characteristics so that a desired surface finish can be formed in less time and with reduced cost.

The donor roll outer surface should also have sufficient wear resistance to resist abrasion when contacted by other surfaces.

This invention provides rolls that have outer coatings with physical, electrical and chemical properties that enable charged toner particles to effectively and controllably adhere electrostatically to the donor roll, and to be effectively donated to a photoconductive member to form an images.

This invention separately provides rolls having coatings with tunable electrical properties.

This invention separately provides rolls having an outer surface with a highly smooth finish.

This invention separately provides rolls having a coating with improved machining characteristics.

This invention separately provides rolls that have a wear resistant outer surface.

This invention separately provides methods of making such rolls.

Exemplary embodiments of the rolls according to this invention comprise a core and an outer coating formed over the core. In some embodiments, the outer coating consists essentially of stabilized zirconia. The outer coating can provide a smooth finish and controlled electrical properties. These and other properties of the outer coating make the rolls highly suitable for use in electrostatographic imaging apparatus.

The outer coatings of the rolls can be finished to the desired finish in reduced cycle times as compared to known coating materials such as alumina and aluminatitania blends.

Other exemplary embodiments of the rolls according to this invention comprise a core and an outer coating comprising a blend of stabilized zirconia and titania formed over the core. The addition of titania to zirconia increases the conductivity of the outer coating. The amount of titania in the coating can be varied to achieve the desired electrical properties.

Exemplary embodiments of the methods of forming the rolls according to this invention comprise applying a stabilized zirconia-containing outer coating over a core. The outer coating can be applied by any suitable coating process.

BRIEF DESCRIPTION OF THE DRAWINGS

The preferred embodiments of this invention will be described in detail, with reference to the following figures, in which.

DETAILED DESCRIPTION OF PREFERRED EMBODIMENTS

Figure 1:
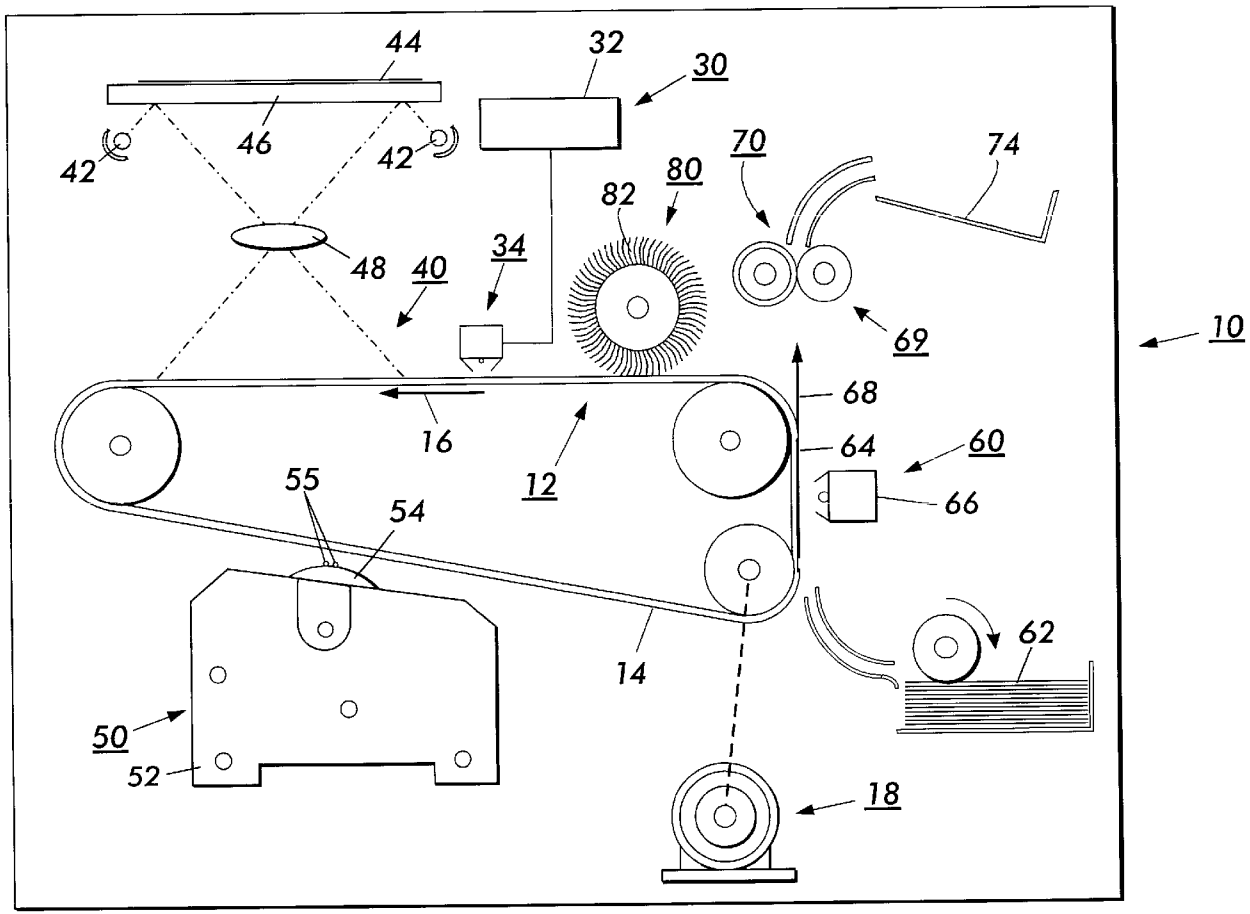
FIG. 1 illustrates a scavengeless electrostatographic development apparatus including an exemplary embodiment of a donor roll according to this invention.

FIG. 1 shows a scavengeless electrostatic imaging apparatus 10 including an exemplary embodiment of a donor roll 54 according to this invention. The imaging apparatus 10 includes an image bearing member in the form of a belt 12 having an outer photoconductive surface 14. The image bearing member can alternatively comprise other types of photoconductive image bearing members, such as a drum having a photoconductive surface. The belt 12 moves in the direction of the arrow 16 to advance successive portions of the photoconductive surface 14 sequentially through various processing stations during the imaging process. The belt 12 is driven by a motor 18.

Initially, a portion of the belt 12 passes through a charging station 30 where a power supply 32 causes the corona generating device 34 to charge a portion of the photoconductive surface 14 of the belt 12.

The charged portion of the belt 12 is advanced to a exposure station 40. At the exposure station 40, one or more light sources such as lamps 42 emit light that is reflected onto an original document 44 seated on a transparent platen 46. The light reflected imagewise from the original image of the document 44 is transmitted through a lens 48. The lens 48 focuses the imagewise light onto the charged portion of the photoconductive surface 14 to selectively dissipate the charge to form a latent image. The latent image formed on the photoconductive surface 14 corresponds to the informational areas contained within the original image of the document 44. For such imagewise exposure of the photoconductive surface 14 in a digital copier, a laser printer and the like, a raster output scanner (ROS) can alternatively be used instead of the lamps 42 and lens 48.

After the electrostatic latent image is formed on the photoconductive surface 14, the belt 12 advances the latent image to a development station 50. At the development station 50, a development apparatus 52 develops the latent image recorded on the photoconductive surface 14 to form a toner image.

The belt 12 then advances the toner image to a transfer station 60 where a copy sheet 62 is advanced by a sheet feeding apparatus 64 to transfer the toner image to the sheet 62. The transfer station 60 also includes a corona generating device 66, which sprays ions onto the sheet 62 to attract the toner image from the photoconductive surface 14 onto the sheet 62. After this image transfer, the sheet 62 is separated from the belt 12 and moved in the direction of the arrow 68 by rollers 69 to a fusing station 70.

The fusing station 70 includes a fuser assembly that heats, fuses and permanently affixes the toner image to the sheet 62, forming a sheet copy of the original image of document 44. The sheet 62 is then advanced to a tray 74.

The belt 12 moves the portion of the surface 14 from which the image had been transferred to the sheet 62 to a cleaning station 80. The cleaning station 80 can include a brush 82 or the like that rotates in contact with the photoconductive surface 14 to remove the residual toner particles. Next, light is emitted onto the photoconductive surface 14 to dissipate any residual electrostatic charge on the belt 12.

Figure 2:
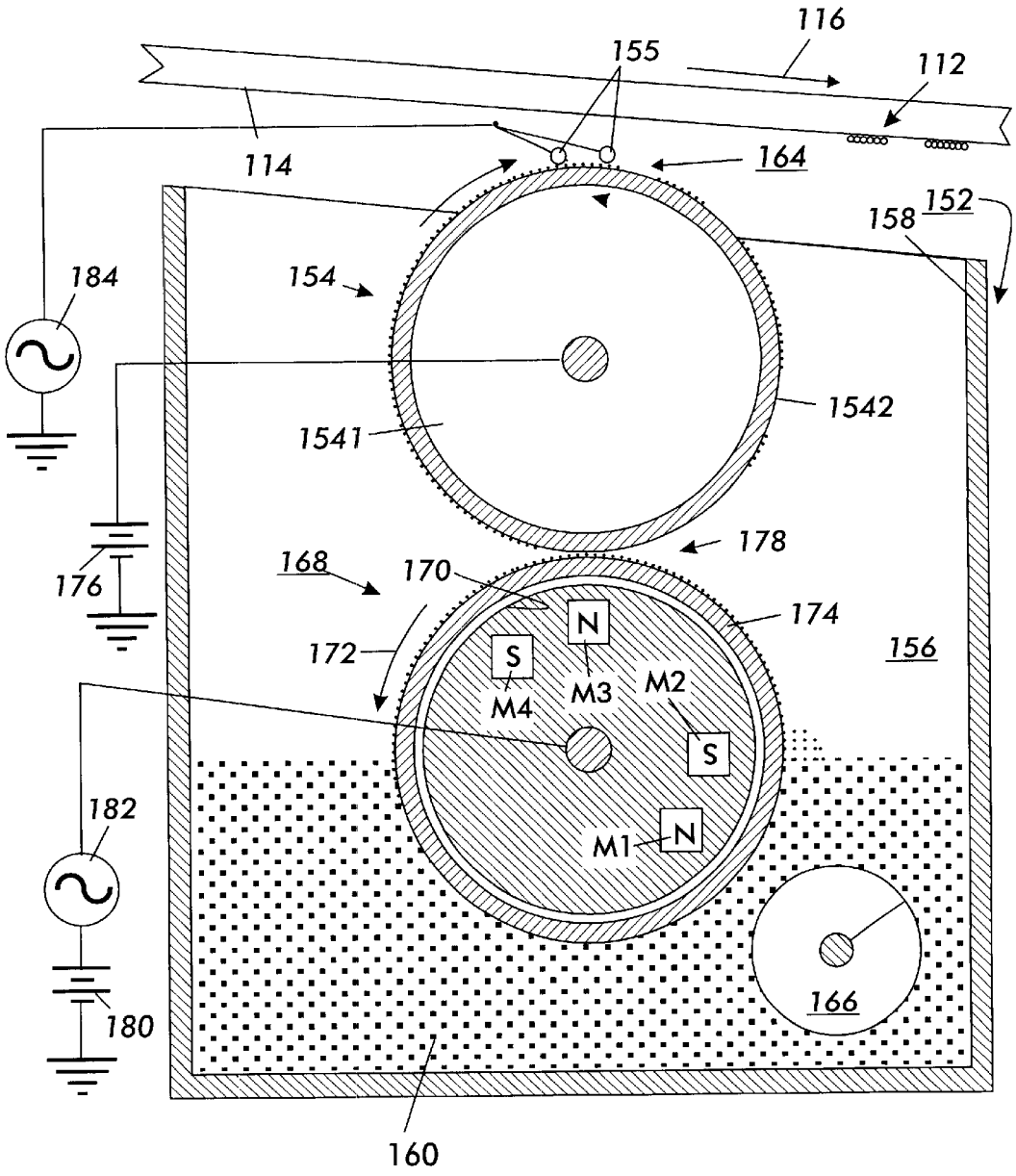
FIG. 2 illustrates a two-component, hybrid scavengeless development device including an exemplary embodiment of a donor roll according to this invention.

FIG. 2 shows a hybrid scavengeless two-component development apparatus 152 including an exemplary embodiment of a donor roll 154 according to this invention. The donor roll 154 is mounted partially within a mixing chamber 156 defined by a housing 158. The mixing chamber 156 holds a supply of a two-component developer material 160 comprising toner particles and carrier beads. The donor roll 154 transports toner particles that have been fed from the mixing chamber 156 into contact with electrode wires 155 within a development zone 164 for latent image development. The developer material 160 is moved and mixed within the mixing chamber 156 by a mixing device 166 to charge the carrier beads and toner particles. The oppositely charged toner particles adhere triboelectrically to the charged magnetizable carrier beads.

The development apparatus 152 also includes a developer material feeder assembly, such as a magnetic roll 168, that feeds a quantity of the developer material 160 from the mixing chamber 156 to the donor roll 154. The magnetic roll 168 includes a substrate 170. The substrate 170 rotates in the direction of the arrow 172, and includes a coating 174, and magnetic members M1 to M4. The magnetic roll 168 and the donor roll 154 are electrically biased relative to each other so that charged toner particles of the developer material 160 fed to the donor roll 154 are attracted from the magnetic roll 168 to the donor roll 154.

In some other embodiments, the coating 174 is not needed on the substrate 170 to provide the desired transport properties. In addition, the substrate 170 can include a different number of magnetic members than the four magnetic members M1 to M4 in FIG. 2.

As also shown in FIG. 2, the donor roll 154 is biased to a specific voltage by a direct current (DC) power supply 176 so that the donor roll 154 attracts charged toner particles from the magnetic roll 168 in a nip 178. To enhance the attraction of charged toner particles from the mixing chamber 156, the magnetic roll 168 is also biased by a DC voltage source 180. The magnetic roll 168 is also biased by an AC voltage source 182 that temporarily loosens the charged toner particles from the magnetized carrier beads. The loosened charged toner particles are attracted to the donor roll 154. An AC bias is also applied to the electrode wires 155 by an AC voltage source 184 to loosen charged toner particles from the donor roll 154, and to form a toner cloud within the development zone 164.

Other embodiments of the hybrid scavengeless two-component development apparatus 152 can comprise more than one donor roll 154, such as, for example, two donor rolls 154. Such apparatus can also include more than one magnetic roll 168 and more than one mixing device 166.

The donor roll 154 can also be used in scavengeless single-component development apparatus.

Figure 3:
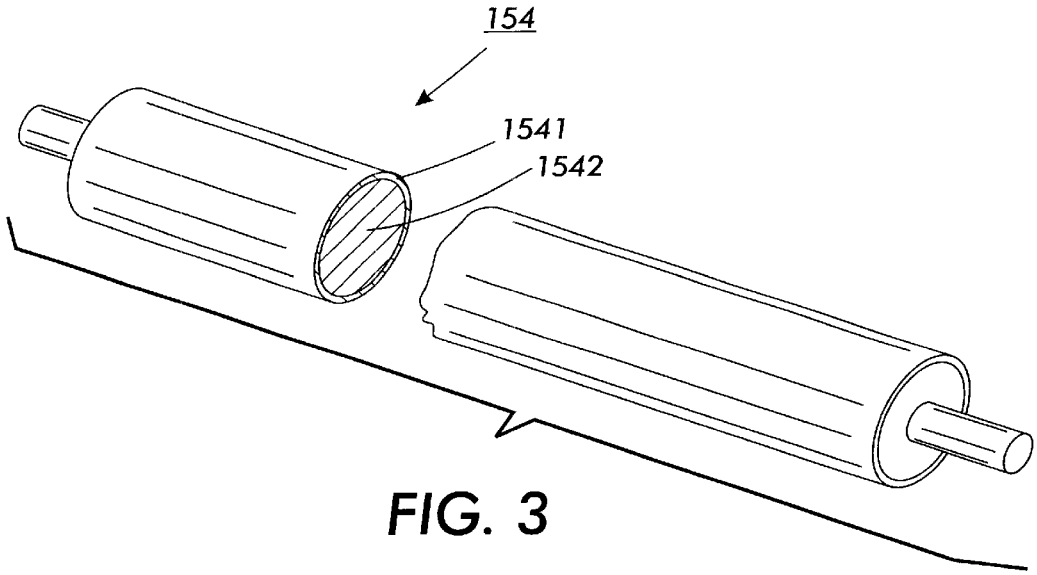
FIG. 3 illustrates an exemplary embodiment of a donor roll according to this invention.

As shown in FIG. 3, exemplary embodiments of the donor rolls 154 according to this invention include a core 1541 and an outer surface coating 1542. The core 1541 can comprise any suitable material that has desired electrical conducting properties. The material forming the core 1541 should be able to withstand the temperatures that are typically reached during the process of coating the core 1541, as described in detail below. The core 1541 can be formed, for example, of metallic materials. Ferrous materials such as steels and stainless steels can be used to form the core 1541. In addition, non-ferrous materials such as aluminum and aluminum alloys, and copper-based materials such as brass, can be used to form the core 1541.

Further, non-metallic materials such as glass, fiber-reinforced resins, composites, ceramics and high-temperature plastics can be used to form the core 1541. For the non-metallic core materials, the core 1541 and coating 1542 are electrically grounded.

The core 1541 is typically cylindrical shaped.

The coating 1542 comprises a ceramic material. In certain exemplary embodiments of the donor roll 154 according to this invention, the coating 1542 consists essentially of stabilized zirconium oxide or zirconia. Zirconia provides a smoother surface finish to the coating 1542 than can be achieved using known coating compositions that have been applied on donor rolls, such as coatings having a high percentage of alumina.

The surface smoothness of the coating 1542 can be quantitatively characterized by known surface roughness measurement and characterization equipment. In embodiments of the coating 1542, the surface of the coating 1542 can have a maximum waviness Wt of less than about 2 $\mu$m and a surface smoothness or arithmetical mean roughness Ra of less than about 1.5 $\mu$m after completion of all finishing operations on the coating 1542. In other embodiments of the coating 1542, the surface of the coating 1542 can be even smoother and can have a maximum waviness Wt of less than about 1 $\mu$m, and a surface smoothness or arithmetical mean roughness Ra of less than about 0.7 $\mu$m, after all finishing operations have been performed on the coating 1542.

In addition, zirconia provides the important advantage that it can be more easily prepared to the desired surface finish characteristics than known coating materials used for donor rolls, such as alumina and alumina-titania compositions. That is, zirconia can be machined, such as by grinding, to a smoother, i.e., lower roughness, finish than known coating materials such as those containing alumina. Typically, the arithmetical mean roughness Ra that can be achieved for alumina is about three times that of zirconia. The maximum waviness Wt that can be achieved for alumina is also higher than that for zirconia.

In addition, the highly smooth surface finishes provided by zirconia coatings 1542 permit reduced machining cycle times and smoother surface finishes as compared to known coatings. For example, the machining cycle time for the zirconia coatings 1542 can be as much as about 30% lower than for known alumina coatings. This high cycle time is necessitated by the slow traverse speed and small depth of cut that must be used in grinding alumina. Zirconia has lower erosion resistance and lower hardness than alumina. Consequently, zirconia can be machined to a desired surface finish in lower cycle times than alumina.

The zirconia material forming the coating 1542 can be stabilized by the addition of any suitable stabilizing component. The stabilizing component is added to zirconia in an effective amount to achieve the desired mechanical properties including ductility. Suitable exemplary stabilizing components for zirconia include one of yttria, magnesium oxide, calcia and ceria. The stabilizing component is alloyed with pure zirconia powder to form zirconia alloy powder, i.e., stabilized zirconia. The stabilizing component prevents a crystal structure change during the thermal cycle. The structure of the stabilized zirconia has better mechanical properties, including improved fracture toughness and strength, than many ceramic materials. The unusually high fracture toughness of the stabilized zirconia enables the coating 1542 to absorb energy like a ductile metal, rather than exhibiting brittle fracture behavior as in most ceramic materials. In addition, stabilized zirconia has a lower hardness and less erosion resistance than aluminia. Consequently, stabilized zirconia coatings 1542 have improved machining characteristics.

Typically, the stabilizing component in zirconia to form the coating 1542 is added in an amount of from about 5 wt % to about 30 wt % to achieve the desired mechanical properties of the coating 1542.

In some exemplary embodiments of the coating 1542 according to this invention, the coating 1542 comprises blends of stabilized zirconia and titanium oxide or titania. In such exemplary embodiments, the coating 1542 comprises at least about 75 wt % of stabilized zirconia and the balance of up to about 25 wt % of titania. In other exemplary embodiments of the coating 1542 according to this invention, the coating 1542 comprises at least about 95 wt % of zirconia and balance of up to about 5 wt % of titania.

The addition of titania further increases the electrical conductivity above that of pure stabilized zirconia. Both zirconia and titania themselves become semiconductive via thermal spray processes that can be used to form the zirconia/titania coating 1542. Titania achieves a lower level of resistivity than zirconia. This reduced resistivity may be desirable in some applications. Accordingly, by varying the amount of titania in the coating 1542, the electrical resistivity of the coating 1542 can be tuned to the desired value.

However, in some exemplary embodiments of the coating 1542, coatings 1542 that consist essentially of stabilized zirconia can provide the desired electrical properties of the donor roll 154.

The composition of the coating 1542 can be selected to provide the desired electrical properties to the donor roll 154. These electrical properties include electrical resistivity, which is the inverse of electrical conductivity, and breakdown voltage protection. Typically, the electrical resistivity of the coating 1542 is from about $10^3$ Ω·cm to about $10^{10}$ Ω·cm. In some exemplary embodiments of the donor roll 154, the coating 1542 has an electrical resistivity of from about $10^6$ Ω·cm to about $10^{10}$ Ω·cm.

Suitable zirconia and titania materials for forming the coating 1542 are commercially available from the Norton Company of Worchester, Massachusetts. The zirconia and titania materials are typically provided in powder form. The zirconia powders can have a typical particle size of from about 5 $\mu$m to about 150 $\mu$m. The titania powders can have a typical particle size of from about 5 $\mu$m to about 150 $\mu$m. It is desirable that the powders be in a dry condition to provide increased deposition efficiency and coating quality of the coating 1542.

The coating 1542 can be applied onto the core 1541 by any suitable coating process. However, without using a thermal spray process, the desired electrical properties may not be achieved. The insulative zirconia powder is transformed into a semi-conductive coating through the thermal spray process. Typically, the coating 1542 is applied by a thermal spraying process. For example, the coating 1542 can be applied by plasma spraying. A suitable plasma spraying device for applying the coating 1542 is a Praxair SG100 plasma spray gun commercially available from Praxair Surface Technologies of Appleton, Wisconsin. Suitable arc gases for the plasma spraying process include argon and helium. Hydrogen may also be used. Suitable process parameters, including the gas flow rates, energy level, powder feed rate and plasma spraying device standoff distance, can be selected to provide the desired characteristics of the coating 1542.

Other thermal spraying processes, such as high-velocity oxy-fuel (HVOF) processes, can also be used to form the coating 1542 on the core 1541.

The coating 1542 can be applied to cover substantially the entire outer surface of the core 1541. In some embodiments, however, it may be desirable to coat most of the outer surface of the core 1541, but to leave selected uncoated regions on the outer surface of the core 1541, such as near the ends of the roll 154. The ends or faces of the core 1541 are typically also coated.

The coating 1542 is applied onto the core 1541 after a suitable surface finish has been formed on the core 1541. Typically, the core 1541 outer surface is prepared, such as by grit blasting, to provide a suitable surface for applying the coating 1542 onto the core 1541. A suitable roughness of the surface of the core 1541 on which the coating 1542 is applied is typically about 3 $\mu$m or more. This roughness level of the surface of the core 1541 is typically suitable to achieve sufficient mechanical interlocking with the coating 1542 to provide good adhesion.

In exemplary embodiments, a bond coat can be applied on the core 1541 to enhance adhesion of the coating 1542 on the core 1541. The bond coat can also increase the resistance of the coating 1542 to cracking or other defects during cooling after the coating process of the coating 1542. The bond coat can comprise any suitable material, such as a mixture of chrome-aluminum-yttrium-cobalt, or a mixture of nickel-aluminum powder.

In some exemplary embodiments, the donor roll 154 can also comprise a protective overcoat applied over the coating 1542. Suitable overcoats are described in U.S. application Ser. No. 09/364,297, filed on Jul. 30, 1999, and incorporated herein by reference in its entirety. The overcoat is applied to prevent, or at least reduce the effects of, wear and moisture penetration. In addition, the overcoat can be applied to tune the physical properties and performance characteristics of the coating 1542, including, for example, friction and conductivity. Suitable exemplary overcoat materials include waxes, polymeric resins and metal oxides.

The cooling rate of the coating 1542 can be controlled to reduce the thermal differential between the core 1541 and the coating 1542, to thereby reduce the generation of thermal stresses in the coating 1542. Cooling can be controlled by directing a gas flow onto the core 1541 during the coating process. In addition, the core 1541 can be preheated to a suitable temperature to reduce the thermal differential between the core 1541 and the coating 1542. Preheating the core 1541 also promotes the adhesion of the coating 1542. Typically, the temperature of the core 1541 and the coating 1542 are maintained below about 300° F. to achieve a suitable thermal differential and good coating adhesion.

The thickness of the coating 1542 as formed on the core 1541 by the thermal spraying process is typically from about 75 $\mu$m to about 450 $\mu$m. In some exemplary embodiments of the donor roll 154, the coating 1542 has a thickness of from about 100 $\mu$m to about 400 $\mu$m as applied on the respective core 1541.

An unfinished donor roll typically has an arithmetic mean roughness Ra of from about 3 $\mu$m to about 7 $\mu$m. This surface smoothness level may not be completely satisfactory for some high-precision electrostatographic development applications. Accordingly, in some exemplary embodiments of the coating 1542, the coating 1542 formed on the respective core 1541 by a thermal spraying process is finished by a machining process to achieve a desired final finish having a suitable low roughness. The coating 1542 provides the advantage that a highly smooth surface finish can be formed using known grinding and polishing techniques. Typically, the coating 1542 can be finished using a suitable grinding device and abrasive material, such as by diamond grinding, to achieve the desired surface roughness. In such embodiments, the final thickness of the coating 1542 is less than its applied thickness. Accordingly, the applied thickness of the coating 1542 is selected to compensate for the coating material that is removed by the finishing process.

As described above, the stabilized-zirconia containing coatings 1542 are advantageous for donor rolls 154 used in various types of scavengeless development systems, including both single and double-component developer material systems.

However, it will be appreciated by those skilled in the art that the coatings 1542 can be also be formed on other type of rolls used in imaging and printing apparatus, including color printing, that would benefit from a coating having controlled electrical properties, as well as improved machining properties. Such other types of rollers can be included in various types of electrostatographic imaging apparatus, including digital systems.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. An electrostatographic imaging apparatus, comprising:

a roll comprising:

a core; and an outer coating consisting essentially of stabilized zirconia formed over the core, wherein the outer coating has an arithmetical mean roughness Ra of less than about 0.7 $\mu$m and a maximum waviness of less than about 1.0 $\mu$m, and wherein the outer coating has an electrical resistivity of from about $10^3$ Ω·cm to about $10^{10}$ Ω·cm.

2. The electrostatographic imaging apparatus of claim 1, wherein the stabilized zirconia is stabilized with a compound selected from the group consisting of yttria, magnesium oxide, calcia and ceria.

3. The electrostatographic imaging apparatus of claim 1, wherein the outer coating has an electrical resistivity of from about $10^6$ Ω·cm to about $10^6$ Ω·cm.

4. The electrostatographic imaging apparatus of claim 1, wherein the roll is a charge donor roll.

5. The electrostatographic imaging apparatus of claim 1, further comprising a bond coat between the core and the outer coating to enhance adhesion of the outer coating to the core.

6. The electrostatographic imaging apparatus of claim 1, further comprising an overcoat over the outer coating.

7. A roll comprising:

a core; and an outer coating formed over the core, the outer coating comprising at least about 75 wt % stabilized zirconia and a balance of titania.

8. The roll of claim 7, wherein the stabilized zirconia is stabilized with a compound selected from the group consisting of yttria, magnesium oxide, calcia and ceria.

9. The roll of claim 7, wherein the outer coating has an arithmetical mean roughness Ra of less than about 0.7 $\mu$m and a maximum waviness of less than about 1 $\mu$m after finishing.

10. The roll of claim 9, wherein the outer coating has an electrical resistivity of from about $10^3$ Ω·cm to about $10^{10}$ Ω·cm.

11. The roll of claim 10, wherein the roll is a charge donor roll.

12. An electrostatographic imaging apparatus comprising a roll according to claim 11.

13. The roll of claim 9, wherein the outer coating has an electrical resistivity of from about $10^6$ Ω·cm to about $10^{10}$ Ω·cm.

14. The roll of claim 7, wherein the roll is a charge donor roll.

15. An electrostatographic imaging apparatus comprising a roll according to claim 14.

16. The roll of claim 7, further comprising a bond coat between the core and the outer coating to enhance adhesion of the outer coating to the core.

17. The roll of claim 7, further comprising an overcoat over the outer coating.

18. A method of making a roll according to claim 7, comprising applying an outer coating over a core, the outer coating comprising at least about 75 wt % stabilized zirconia and a balance of titania.

19. The method of claim 18, wherein the stabilized zirconia is stabilized with a compound selected from the group consisting of yttria, magnesium oxide, calcia and ceria.

20. The method of claim 18, wherein the outer coating has an arithmetic mean roughness Ra of less than about 0.7 $\mu$m and a maximum waviness of less than about 1 $\mu$m after finishing.

21. The method of claim 18, wherein the outer coating has an electrical resistivity of from about $10^3$ Ω·cm to about $10^{10}$ Ω·cm.

22. The method of claim 18, wherein the outer coating has an electrical resistivity of from about $10^6$ Ω·cm to about $10^{10}$ Ω·cm.

23. The method of claim 18, wherein the outer coating is applied on the core by thermal spraying.

24. The method of claim 18, wherein the core comprises an electrically conductive material.

25. A roll comprising:

a core formed of a non-ferrous material; and an outer coating consisting essentially of stabilized zirconia formed over the core, wherein the outer coating has an electrical resistivity of from about $10^6$ Ω·cm to about $10^{10}$ Ω·cm.

26. The roll of claim 25, wherein the core is formed of a material selected from the group consisting of aluminum, aluminum alloys and copper-based materials.

27. A roll comprising:

a core formed of a non-metallic material; and an outer coating consisting essentially of stabilized zirconia formed over the core, wherein the outer coating has an electrical resistivity of from about $10^6$ Ω·cm to about $10^{10}$ Ω·cm.

28. The roll of claim 27, wherein the core is formed of a material selected from the group consisting of glass, fiber-reinforced ceramics, composites, ceramics and high-temperature plastics.

* * * * *